US005685574A

United States Patent [19]

Kohli et al.

[11] Patent Number: 5,685,574

[45] Date of Patent: Nov. 11, 1997

[54] SNAP LATCH SEAL LOCATOR FOR SEALINGLY LATCHING TUBING TO A PACKER IN A WELLBORE

[75] Inventors: Harjit S. Kohli, Sugarland; L. Michael McKee, Alvin; Raghu Madhavan, Houston; Andrew J. Tucker, Alvin, all of Tex.

[73] Assignee: Dowell, a division of Schlumberger Technology Corporation, Houston, Tex.

[21] Appl. No.: 396,410

[22] Filed: Feb. 28, 1995

[51] Int. Cl.[6] ..... F16L 35/00

[52] U.S. Cl. ..... 285/35; 285/304; 285/319; 285/922; 166/255.1

[58] Field of Search ..... 166/250.13, 255.1; 294/86.18, 86.22, 86.25; 285/34, 35, 322, 319, 323, 922, 146, 304; 295/100, 105

[56] References Cited

U.S. PATENT DOCUMENTS

| | | | |
|---|---|---|---|
| 2,493,556 | 1/1950 | Stone | 285/146 |
| 2,691,418 | 10/1954 | Connolly | 285/105 X |
| 2,751,019 | 6/1956 | Baker | 285/34 |
| 2,870,794 | 1/1959 | Thaxton | 285/146 X |
| 2,917,114 | 12/1959 | Levendoski | 285/34 X |
| 3,071,188 | 1/1963 | Raulins | 285/34 X |
| 3,127,198 | 3/1964 | Orund | 285/146 |
| 3,739,865 | 6/1973 | Wolda . | |
| 3,912,009 | 10/1975 | Davis | 285/34 X |
| 4,767,135 | 8/1988 | Holzmann | 285/322 X |
| 4,828,035 | 5/1989 | McInturff . | |

FOREIGN PATENT DOCUMENTS 2152303 7/1985 United Kingdom .

*Primary Examiner*—Dave W. Arola
*Attorney, Agent, or Firm*—John E. Vick, Jr.

[57] ABSTRACT

A latch is adapted to be connected to a tubing string and will snap into a packer disposed in a wellbore. A predetermined first number of pounds is required to snap the latch into the packer and a predetermined second number of pounds, greater than the first number, is required to pull the latch out of the packer in the wellbore. In order to maintain constant the first and second number of pounds, the latch has the following special characteristics. The latch has a plurality of flanges separated, respectively, by a plurality of gaps, that snap into the packer, each flange having external threads disposed around its periphery, each thread including an engaging surface and a disengaging surface, an angle between the surface of each disengaging thread relative to a vertical being in a range from 20 to 28 degrees. An elastomeric barrier occupies the gap between adjacent ones of the flanges. A distance exists between each of the flanges and an adjacent snap latch body, the flanges being adapted to bend and disengage across the distance, the distance being 2½ to 3 times a particular distance that is required for the flange to snap out of the packer in the wellbore when an operator pulls upwardly on the tubing. The geometry of the flange is selected to minimize a lever arm extending between an axially applied force applied axially to the external threads and a center of gravity of the flange at the base, the lever arm being approximately equal to zero. An outer diameter of each flange of the latch is greater than an inner diameter of an inner mandrel of the packer plus a tolerance stackup. The number of external threads on the periphery of each flange is minimized in order to further minimize the number of disengaging loads created when the latch is pulled out of the packer by the operator at the wellbore surface. This will assist in establishing as a certainty the second number of pounds of pulling force which is required in order to pull the tubing and the snap latch of the present invention out of the packer in the wellbore and the first number of pounds of pushing force required to snap the tubing and the snap latch into the packer in the wellbore.

18 Claims, 6 Drawing Sheets

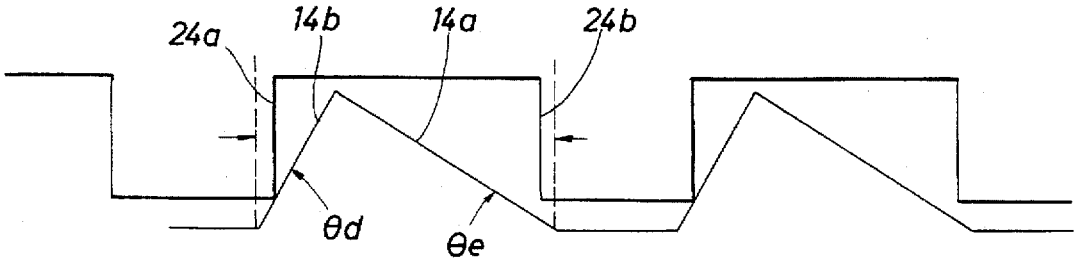
FIG. 7
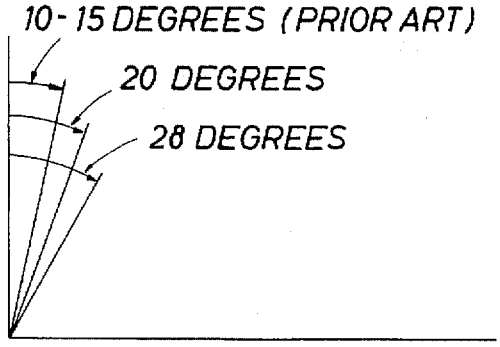
FIG. 8
FIG. 9
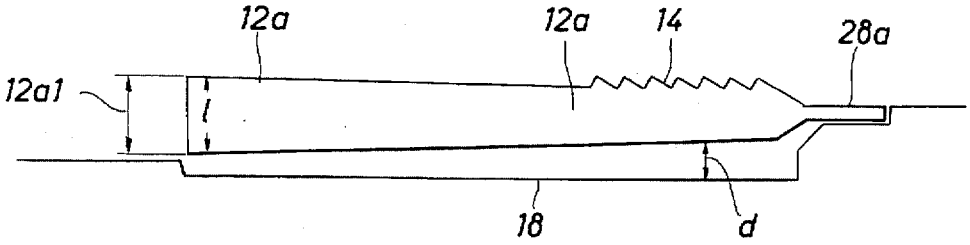
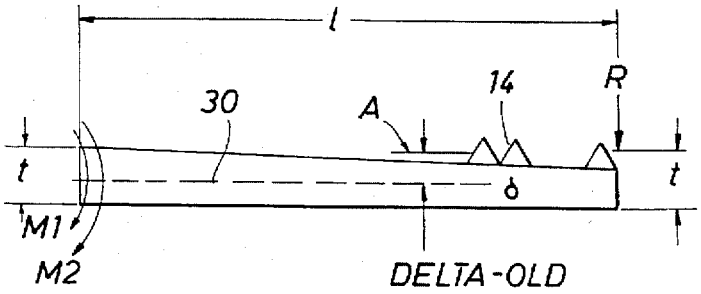
FIG. 10
(PRIOR ART)

SNAP LATCH SEAL LOCATOR FOR SEALINGLY LATCHING TUBING TO A PACKER IN A WELLBORE

BACKGROUND OF THE INVENTION

The subject matter of the present invention relates to a snap latch seal locator adapted to be connected on one end to a tubing string for latching the tubing string to a packer disposed in a wellbore and for simultaneously locating a plurality of seals inside the packer, the seals providing a fluid right seal between an internal part of the packer and an external part of the tubing.

A snap latch is used to interconnect a tubing string to a packer disposed in a wellbore. An operator at the surface of the wellbore connects the snap latch to a tubing string and lowers the snap latch and accompanying tubing string into the wellbore until the snap latch locates the packer already disposed in the wellbore. The snap latch includes a plurality of flanges, and the flanges are designed to snap into an internal part of the packer. When the flanges of the snap latch are snapped into the packer, wellbore operations may commence. It may be necessary to disconnect the snap latch from the packer and pull the tubing string out of the wellbore to a surface of the wellbore. In this case, the operator at the surface pulls upwardly on the tubing. In response to the pull upwardly on the tubing, since the snap latch is connected to the tubing, the flanges of the snap latch are supposed to bend inwardly and disconnect from the internal part of the packer. The flanges include a plurality of externally disposed threads (herinafter called external threads) which are disposed on an external periphery of the flange, the external threads on the flange mating with a corresponding plurality of internally disposed threads (hereinafter called internal threads) disposed around an internal periphery of the internal part of the packer mandrel. The external threads of the flange are shaped differently than the internal threads of the packer. The external threads include a disengaging surface disposed at a disengaging angle relative to a vertical and an engaging surface disposed at an engaging angle relative to a vertical, whereas the internal threads are primarily square-shaped, each square shaped internal thread including a rising surface and a falling surface. When the snap latch is snapped into the packer, the disengaging surface of an external thread is in contact with the rising surface of an internal thread, and the engaging surface of the external thread is in contact with the failing surface of the internal thread.

However, a first problem is encountered when wellbore debris is disposed between the disengaging surface of the external threads of a flange and the rising surface of the internal threads of the packer. The debris will actually increase the frictional contact between the disengaging surface and the rising surface. This increased frictional contact can cause the flange to bend outwardly instead of inwardly when the operator pulls upwardly on the tubing at the wellbore surface, and this outward bending of the flange makes it more difficult for the operator to disconnect the snap latch from the packer. Therefore, it becomes more difficult to disconnect the tubing string from the packer and pull the tubing string out of the wellbore. Therefore, the external threads on the flange must be redesigned to prevent this problem. Furthermore, if the tubing string cannot be disconnected from the packer during the pull upwardly on the tubing in the wellbore, a safety shear sub, connected in the tool string below the snap latch, may snap.

In addition, a second problem is encountered when other additional wellbore debris occupies the gaps disposed between the flanges of the snap latch and accumulates on an undersurface of the flange. This additional debris also makes it more difficult for the operator to pull upwardly on the tubing and disconnect the snap latch from the packer. In addition, when further debris accumulates in a space disposed between the flange of the latch and a snap latch body, this space is oftentimes too small and, as a result, inward bending of the flange is inhibited due to the accumulation of the further debris in the space.

In addition, a third problem is encountered due to a lengthy radial distance or lever arm between the center of gravity of the flange and an axially applied force acting on the threads on the flange, this lengthy lever arm creating an undesired auxiliary bending moment in addition to the normal and expected bending moment caused by a transversely applied force acting on the engaging surface of the threads of the flange. Recalling that the objective of the snap latch of the present invention is to make it harder to disengage the tubing from the packer and easier to engage the tubing to the packer, the undesired auxiliary bending moment makes it easier to disengage the tubing from the packer and harder to engage the tubing to the packer, which is the opposite of what we want and is the reason why we must eliminate the auxiliary bending moment.

In addition, a fourth problem is encountered due to the tolerance or error caused by machining the outer diameter of the latch flange. When machining the flange, the outer diameter (OD) of the flange, where the engaging and disengaging surfaces of the external threads of the flange of the latch are located, is not exactly equal to the inner diameter (ID) of a mandrel, where the rising and falling surfaces of the square shaped internal threads are located. The difference between the OD of the flange and the ID of the mandrel is the tolerance or error caused during machining of the flange. The amount of engagement between the OD and the ID takes on a range of values; sometimes the OD and the ID are more than touching, and sometimes there is a gap between the OD and the ID). Consequently, the engaging and disengaging surfaces of the external threads of the flange do not exactly mate or come into complete contact with the rising and falling surfaces of the internal threads of the mandrel. This tolerance error must be taken in account when designing the snap latch of the present invention.

In addition, a fifth problem is encountered due to the excessive number of external threads located the exterior surface of the flanges of the snap latch. Each external thread creates a normal (and undesired) bending moment at the base of each flange of the snap latch. Generally speaking, the greater the number of teeth of the external threads that exist on the exterior surface of the flanges, the larger the range of bending moments that exist and the larger the range of engaging and disengaging loads that exist. If there are too many external threads disposed on the exterior surface of the flanges of the latch, there will be an excessive number of bending moments and associated engaging and disengaging loads, and this excessive number of bending moments and associated engaging and disengaging loads will complicate the process of disconnecting the snap latch and associated tubing from the packer disposed in the wellbore. It is therefore more difficult for the operator to disconnect the tubing from the packer and pull the tubing to a surface of the wellbore. Accordingly, a new snap latch design is needed to correct each of the above referenced problems so that the operator at the wellbore surface will know for certain that a predetermined first number of pounds is required to snap the latch into the packer and that a predetermined second number of pounds (greater than the first number) is required to snap the latch out of the packer disposed in the wellbore.

SUMMARY OF THE INVENTION

Accordingly, it is a primary object of the present invention to provide a latch, which is adapted to be connected to a tubing string, that will snap into a packer disposed in a wellbore, a predetermined first number of pounds being required to snap the latch into the packer and a predetermined second number of pounds, greater than the first number, being required to pull the latch out of the packer in the wellbore.

It is a further object Of the present invention to provide a latch, which is adapted to be connected to a tubing string, that will snap into a packer disposed in a wellbore, a predetermined first number of pounds being required to snap the latch into the packer and a predetermined second number of pounds, greater than the first number, being required to pull the latch out of the packer in the wellbore, the latch having a plurality of flanges that snap into the packer, each flange having external threads disposed around its periphery, each thread including an engaging surface and a disengaging surface, an angle between the surface of each disengaging thread relative to a vertical, for a specific size snap latch, being a specific value, the specific value being within a range from 20 degrees to 28 degrees.

It is a further object of the present invention to provide a latch, which is adapted to be connected to a tubing string, that will snap into a packer disposed in a wellbore, a predetermined first number of pounds being required to snap the latch into the packer and a predetermined second number of pounds, greater than the first number, being required to pull the latch out of the packer in the wellbore, the latch having a plurality of flanges separated, respectively, by a plurality of gaps, that snap into the packer, each flange having external threads disposed around its periphery, each thread including an engaging surface and a disengaging surface, an angle between the surface of each disengaging thread relative to a vertical, for a specific size snap latch, being a specific value, the specific value being in a range from 20 to 28 degrees, an elastomeric barrier occupying the gap between adjacent ones of the flanges.

It is a further object of the present invention to provide a latch, which is adapted to be connected to a tubing string, that will snap into a packer disposed .in a wellbore, a predetermined first number of pounds being required to Snap the latch into the packer and a predetermined second number of pounds, greater than the first number, being required to pull the latch out of the packer in the wellbore, the latch having a plurality of flanges separated, respectively, by a plurality of gaps, that snap into the packer, each flange having external threads disposed around its periphery, each thread including an engaging surface and a disengaging surface, an angle between the surface of each disengaging thread relative to a vertical, for a specific size snap latch, being a specific value, the specific value being in a range from 20 to 28 degrees, an elastomeric barrier occupying the gap between adjacent ones of the flanges, a distance existing between each of the flanges and an adjacent snap latch body, the flanges being adapted to bend and disengage across the distance, the distance being 2½ to 3 times a particular distance that is required for the flange to snap out of the packer in the wellbore when an operator pulls upwardly on the tubing.

It is a further object of the present invention to provide a latch, which is adapted to be connected to a tubing string, that will snap into a packer disposed in a wellbore, a predetermined first number of pounds being required to snap the latch into the packer and a predetermined second number of pounds, greater than the first number, being required to pull the latch out of the packer in the wellbore, the latch having a plurality of flanges separated, respectively, by a plurality of gaps, that snap into the packer, each flange having external threads disposed around its periphery, each thread including an engaging surface and a disengaging surface, an angle between the surface of each disengaging thread relative to a vertical, for a specific size snap latch, being a specific value, the specific value being in a range from 20 to 28 degrees, an elastomeric barrier occupying the gap between adjacent ones of the flanges, a distance existing between each of the flanges and an adjacent snap latch body, the flanges being adapted to bend and disengage across the distance, the distance being 2½ to 3 times a particular distance that is required for the flange to snap out of the packer in the wellbore when an operator pulls upwardly on the tubing, each flange having a base which has a particular thickness, the particular thickness being selected to minimize a lever arm extending between an axially applied force applied axially to the external threads and a center of gravity of the flange at the base.

It is a further object of the present invention to provide a latch, which is adapted to be connected to a tubing string, that will snap into a packer disposed in a wellbore, a predetermined first number of pounds being required to snap the latch into the packer and a predetermined second number of pounds, greater than the first number, being required to pull the latch out of the packer in the wellbore, the latch having a plurality of flanges separated, respectively, by a plurality of gaps, that snap into the packer, each flange having external threads disposed around its periphery, each thread including an engaging surface and a disengaging surface, an angle between the surface of each disengaging thread relative to a vertical, for a specific size snap latch, being a specific value, the specific value being in a range from 20 to 28 degrees, an elastomeric barrier occupying the gap between adjacent ones of the flanges, a distance existing between each of the flanges and an adjacent snap latch body, the flanges being adapted to bend and disengage across the distance, the distance being 2½ to 3 times a particular distance that is required for the flange to snap out of the packer in the wellbore when an operator pulls upwardly on the tubing; each flange having a base which has a particular thickness, the particular thickness being selected to minimize a lever arm extending between an axially applied force applied axially to the external threads and a center of gravity of the flange at the base, an outer diameter of each flange of the latch being greater than an inner diameter of an inner mandrel of the packer plus a tolerance stackup, and the number of external threads on the periphery of each flange being minimized in order to further minimize the number of bending moments created when the latch is pulled out of the packer by the operator at the wellbore surface.

In accordance with these and other objects of the present invention, a latch is adapted to be connected to a tubing string and will snap into a packer disposed in a wellbore. A predetermined first number of pounds is required to snap the latch into the packer and a predetermined second number of pounds, greater than the first number, is required to pull the latch out of the packer in the wellbore. The latch has the following special characteristics:

1. The latch has a plurality of flanges separated, respectively, by a plurality of gaps, that snap into the packer, each flange having external threads disposed around its periphery, each thread including an engaging surface and a disengaging surface, an angle between each disengaging surface and a vertical, for a specific size snap latch, being a specific value, the specific value being within a range between 20 degrees and 28 degrees, 2. An elastomeric barrier occupies the gap between adjacent ones of the flanges, 3. A distance exists between each of the flanges and an adjacent snap latch body, the flanges being adapted to bend and disengage across the distance, the distance being 2½ to 3 times a particular distance that is required for the flange to snap out of the packer in the wellbore when an operator pulls upwardly on the tubing, 4. Each flange has a geometry that minimizes an undesirable auxiliary bending moment. As a result, the flange has a base which has a particular thickness, the particular thickness being selected to minimize a lever arm extending between an axially applied force applied axially to the external threads and a center of gravity of the flange at the base such that the lever arm is approximately equal to zero, 5. An outer diameter of each flange of the latch is greater than an inner diameter of an inner mandrel of the packer plus a tolerance stackup, and 6. The number of external threads on the periphery of each flange of the snap latch of the present invention is reduced, relative to the number of external threads on the periphery of each flange of the prior art snap latch, in order to achieve a smaller range of bending moments and therefore a smaller range of engaging and disengaging loads when the latch is pulled out of the packer by the operator at the wellbore surface. This will assist in establishing the second number of pounds of pulling force which is required in order to pull the tubing and the snap latch of the present invention out of the packer in the wellbore.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIG. 7 illustrates the external threads on a flange of the latch portion of FIG. 6 in contact with the internal threads on the mandrel of the packer in the wellbore;

FIG. 8 illustrates the number of degrees of a disengaging angle which extends between the disengaging surface of one of the external threads of the flange of the latch portion of FIG. 6 and a vertical line;

FIG. 9 illustrates a space or distance "d" which exists between one of the flanges of the latch portion of the snap latch of FIG. 6 and a snap latch body of the snap latch, this distance "d" being 2½ to 3 times the distance which is required for the flange of the latch portion to bend and disengage with the square threads of the mandrel of the packer;

FIG. 10 illustrates a flange associated with a snap latch of the prior art, there being an undesired auxiliary moment created by an axially applied force "A" and a lever arm "delta-old";

DETAILED DESCRIPTION OF THE PREFERRED EMBODIMENT

Figure 1:
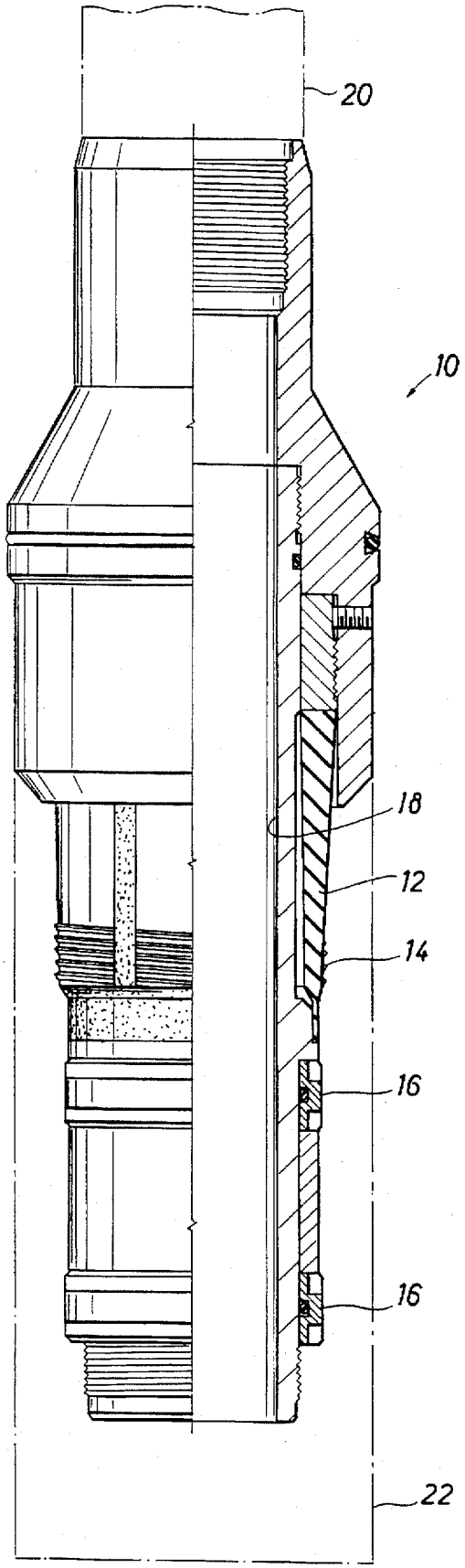
FIG. 1 illustrates a construction of the snap latch seal locator of the present invention.

Referring to FIG. 1, a snap latch seal locator 10 in accordance with the present invention is illustrated.

In FIG. 1, the snap latch seal locator 10 of the present invention is adapted to be interconnected between a tubing string 20 and a packer assembly 22. When the tubing string 20 is connected to the snap latch seal locator 10, the snap latch seal locator is adapted to be lowered into a borehole and the seal locator 10 is "snapped" in place into the packer assembly 22. When desired, a pull upwardly on the tubing string 20 by an operator at the wellbore surface should "unsnap" the snap latch seal locator 10 from the packer assembly 22. At this point, the tubing 20 and snap latch seal locator 10 can be pulled uphole to a surface of the wellbore.

In FIG. 1, the snap latch seal locator 10 includes the latch portion 12 of the snap latch seal locator 10, the latch portion 12 being hereinafter called "a snap latch 12". The snap latch 12 includes a plurality of external threads 14 disposed around an external periphery of the snap latch 12. Actually, the snap latch 12 includes a plurality of flanges, and the external threads 14 are disposed around the external periphery of the flanges of the snap latch 12. The snap latch seal locator 10 further includes a plurality of seals 16 which are adapted to be located within a packer assembly and seals the interior of the packer assembly and seal locator 10 from the exterior thereof. The snap latch 12 of FIG. 1 further includes a plurality of elastomeric barriers disposed, respectively, within a corresponding plurality of gaps located between adjacent flanges of the snap latch; thus, the cross-sectioning of the snap latch 12 as shown in FIG. 1 actually refers to one of the elastomeric barriers disposed in one of the gaps. The elastomeric barrier, the flanges, and the gaps of the snap latch 12 can be seen in greater detail in FIG. 6 and will be discussed in greater detail with reference to FIG. 6. The snap latch 12 is spaced from a snap latch body 18 by a distance "d", shown in greater detail in FIG. 10.

Figure 2:
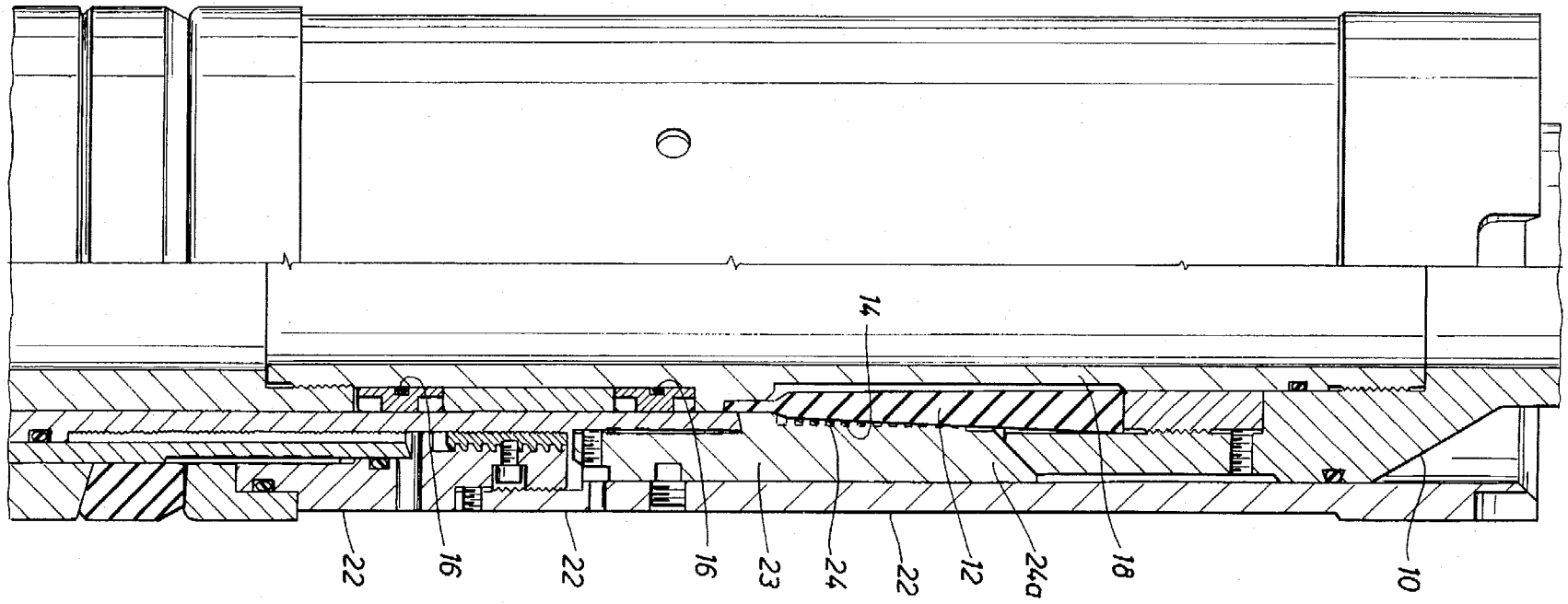
FIG. 2 illustrates the snap latch seal locator of FIG. 1 inserted and snapped into a packer disposed in a wellbore.

Referring to FIG. 2, the snap latch seal locator 10 of FIG. 1 is shown inserted into a packer assembly In FIG. 2, the snap latch seal locator 10 of FIG. 1 has been inserted into the packer assembly 22, and the seals 16 of the seal locator 10 are shown in FIG. 2 to be disposed in sealing engagement with an internal part of the packer assembly 22. Recalling that the snap latch 12 has a plurality of flanges and that the plurality of external threads 14 are disposed around an external periphery of the flanges, in FIG. 2, the external threads 14 on the flanges of the snap latch 12 are shown to be firmly engaged with a plurality of internal threads 24 disposed within the packer assembly 22. More particularly, the packer assembly 22 includes a mandrel 23 and the mandrel 23 has the internal threads 24 disposed around its internal periphery. Note that the internal threads 24 of the mandrel 23 are each square shaped and have two surfaces, a rising surface and a falling surface; however, the external threads 14 of the snap latch 12 also have two surfaces, an engaging surface and a disengaging surface. This construction will be discussed later in this specification.

Figure 3:
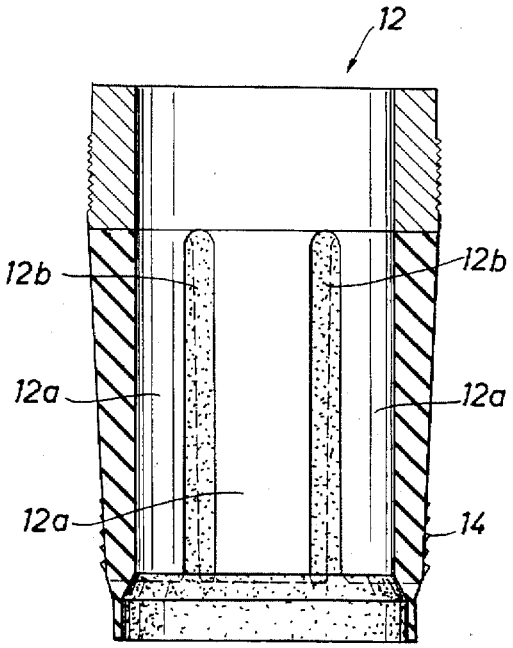
FIG. 3 illustrates a construction of the latch portion of the snap latch seal locator of FIG. 1.

Referring to FIG. 3, the snap latch 12 of FIGS. 1 and 2 is illustrated again and notice that the snap latch 12 includes the external threads 14. The snap latch 12 includes a plurality of flanges 12*a*, each of the flanges 12*a* being separated from an adjacent flange 12*a* by a gap 12*b*. For reasons which will be discussed in more detail later in this specification, an elastomeric barrier (shown in FIG. 3, but better illustrated in FIG. 6) is disposed within each of the gaps 12*b* between adjacent flanges 12*a* of the snap latch 12.

Figure 4:
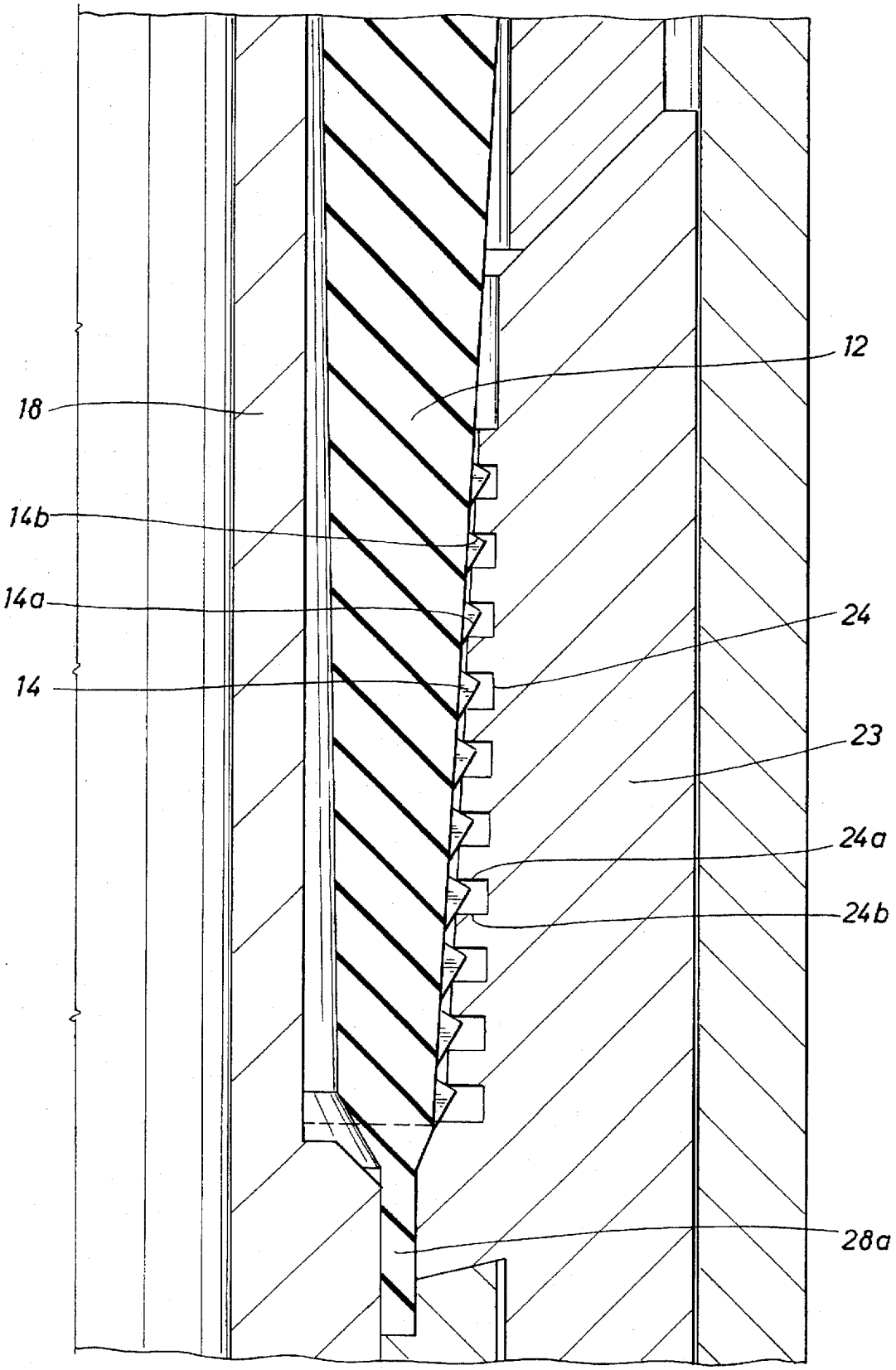
FIG. 4 illustrates an expanded view of the external threads on the latch portion of the snap latch mating with the internal threads on the packer.

Referring to FIG. 4, an expanded view of the snap latch 12 of the snap latch seal locator 10 of the present invention is illustrated. In FIG. 4, the expanded view of the snap latch 12 provides a better view of how the external threads 14 on the snap latch 12 mate with the internal threads 24 of the mandrel 23. In FIG. 4, the external threads 14 disposed around an external periphery of each flange 12*a* of snap latch 12 include an engaging surface 14*a* and a disengaging surface 14*b*. However, the internal threads 24 disposed around an internal periphery of the mandrel 23 include a rising surface 24*a* and a falling surface 24*b*.

In order to pull the snap latch seal locator 10 out of the packer assembly 22 of FIG. 2, the disengaging surface 14*b* of the external threads 14 on each flange 12*a* of the snap latch 12 must disengage from the rising surface 24*a* of the internal threads 24 on the mandrel 23, and, in order to "snap" the snap latch seal locator 10 into the packer assembly 22 of FIG. 2, the engaging surface 14*a* of the external threads 14 on each flange 12*a* of the snap latch 12 must engage with the falling surface 24*b* of the internal threads 24 of the mandrel 23.

However, one major objective of the snap latch seal locator 10 of the present invention is as follows: the amount of pounds of force required to "snap" the snap latch seal locator 10 into the packer assembly 22 of FIG. 2 and connect the tubing string 20 to the packer assembly 22 is 3000 pounds; however, the amount of pounds of force that is required to bend the flanges 12*a* of the snap latch 12, pull the snap latch seal locator 10 out of the packer assembly 22 of FIG. 2, and pull the tubing string 20 out of the wellbore is 15000 pounds.

Therefore, in order to satisfy this major objective, the angle of the disengaging surface 14*b* of the external threads 14 on each flange 12*a* of the snap latch 12, relative to a vertical, is very important, and the angle of the engaging surface 14*a* of the external threads 14 relative to a vertical is also very important. This will be explained in more detail later in this specification.

Figure 5:
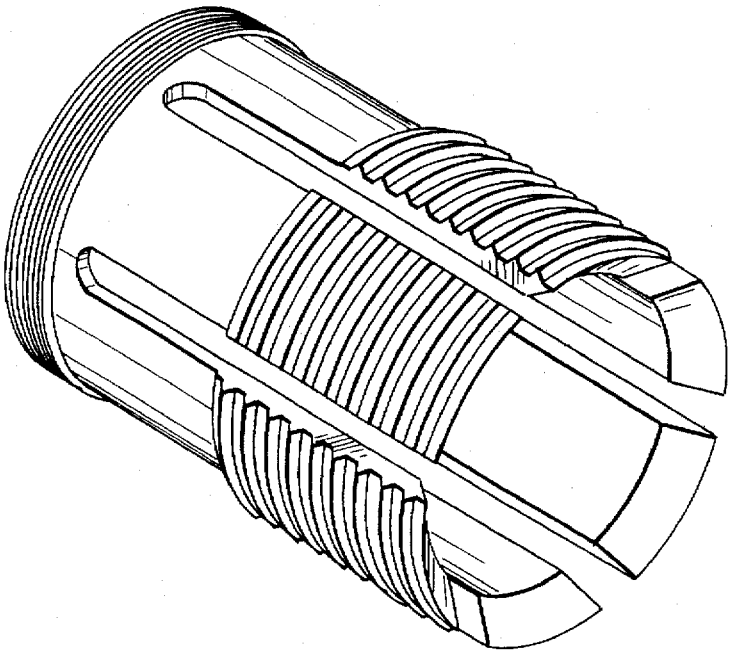
FIG. 5 (PRIOR ART)
FIG. 5 illustrates a three dimensional drawing of a prior art latch portion of a prior art snap latch.

FIG. 5 illustrates a three dimensional drawing of a prior art snap latch.

Figure 6:
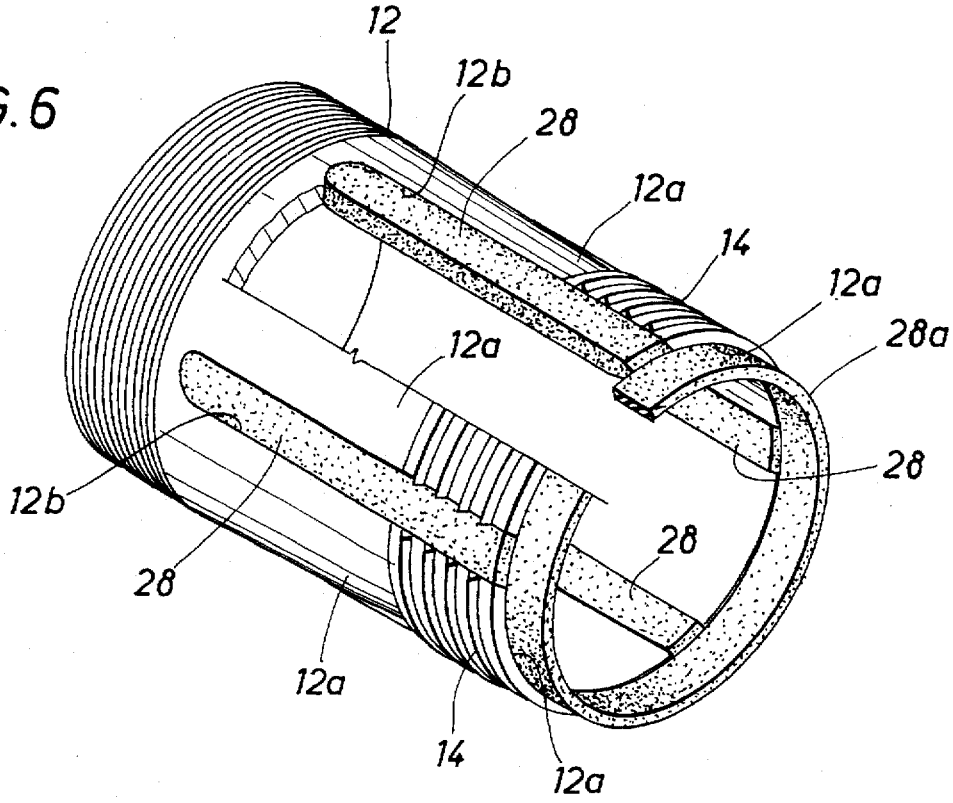
FIG. 6 illustrates a three dimensional drawing of the latch portion of FIG. 3 of the snap latch seal locator of FIG. 1 of the present invention, FIG. 6 illustrating an elastomeric barrier inserted within each of the gaps disposed between adjacent flanges of the latch portion of the snap latch seal locator.

FIG. 6 illustrates a three dimensional drawing of the snap latch 12 of the snap latch seal locator 10 of the present invention. In FIG. 6, recall that six (6) improvements were made to the snap latch seal locator of the prior art when designing the snap latch seal locator 10 of the present invention.

A first improvement to the snap latch seal locator of the prior art relates to an elastomeric barrier 28 disposed within each of the gaps 12*b* between each of the flanges 12*a* of the snap latch 12 of the snap latch seal locator 10 of the present invention. The elastomeric barrier 28 includes a top ring-like part 28*a* and a plurality of extension members 28*b* integrally connected to the top ring-like part 28*a*, the plurality of extension members 28*b* being adapted to be inserted within the plurality of gaps 12*b* disposed between the plurality of flanges 12*a* of the snap latch 12. The elastomeric barrier 28 closes each of the gaps 12*b* between each of the flanges 12*a* of the snap latch 12 and prevents debris, originating from outside the snap latch 12, from entering an interior of the snap latch 12. Without this elastomeric barrier 28, this debris from outside the snap latch 12 will pass through the gaps 12*b* between each of the flanges 12*a* and will begin to build up on an underside on the interior of each flange 12*a*. A debris layer will be deposited on the underside of each flange 12*a*, and, when the operator at the wellbore surface pulls upwardly on the tubing 20 and tries to disengage the tubing 20 from the packer assembly 22, this debris layer deposited on the underside of each flange 12*a* will tend to prevent each flange 12*a* from bending inwardly to a desired extent which is required to disengage the disengaging surface 14*b* of the external threads 14 on the flange from the rising surface 24*a* of the internal threads 24 on the mandrel 23. As a result, without the elastomeric barrier 28, more than 15000 pounds of disengaging force will be required to pull the tubing 20 out of the packer assembly 22 of FIG. 1. Note that the elastomeric barrier 28 includes a tip end 28*a* which prevents the debris from entering an interior of the snap latch 12 (see in particular the location of the tip end 28*a* of elastomeric barrier 28 in FIGS. 1, 2, and 4 of the drawings and note how the tip end 28*a* prevents the passage of any debris from outside to inside the snap latch 12).

Referring to FIGS. 7 and 8, an expanded view of one external thread 14 which is disposed on each flange 12*a* of the snap latch 12 of the snap latch seal locator 10 of the present invention and one internal thread 24 on the mandrel 23 of the packer assembly 22 is illustrated.

In FIG. 7, a disengaging angle $\theta_d$ is defined to be the angle is degrees between each of the disengaging surfaces 14*b* of each of the external threads 14 on each flange 12*a* of the snap latch 12 and a vertical line, whereas the engaging angle $\theta_e$ is defined to be the angle in degrees between each of the engaging surfaces 14*a* of each of the external threads 14 on each flange 12*a* of the snap latch 12 and a vertical line, as shown in FIG. 7.

A second improvement to the snap latch seal locator 10 in accordance with the present invention relates to the disengaging angle $\theta_d$.

In FIG. 8, in the prior art snap latch shown in FIG. 5, the disengaging angle $\theta_d$. was approximately ten (10) degrees. However, gravel and other debris would enter the space between each disengaging surface 14*b* of each external thread and the rising surface 24*a* of each internal thread 24. This debris would increase the coefficient of friction between surface 14*b* and surface 24*a*. As a result, the amount of pull out force required to unsnap the snap latch 12 from the packer assembly 22 was greater than 15000 pounds. Recall that it is necessary to maintain the pull out force at a constant 15000 pounds.

However, in accordance with the second improvement of the present invention, for a specific size snap latch, the disengaging angle $\theta_d$, between each of the disengaging surfaces 14*b* and a vertical line for each external thread 14 on each flange 12*a* of the snap latch 12 of the present invention shown in FIG. 6, is a specific value, the specific value lying within a range between twenty (20 ) degrees and twenty-eight (28) degrees. Recalling that one major objective of the snap latch seal locator 10 is to require a 15000 pound pulling force to unsnap the snap latch 12 from the packer assembly 22 in FIG. 1, since the disengaging angle $\theta_d$., for a specific size snap latch, is a specific value and that specific value now lies in a range between 20 and 28 degrees, the operator at the wellbore surface can now be assured that an approximately constant 15000 pounds is required to unsnap the snap latch 12 from the packer assembly 22 and pull the tubing string 20 to the surface of the wellbore.

Referring to FIG. 9, a distance "d" exists between each flange 12*a* of the snap latch 12 and the snap latch body 18 (see FIG. 1), the distance "d" increasing from the base 12*a*1 of the flange 12*a* to the tip end 28*a* of the flange.

A third improvement to the snap latch seal locator 10 in accordance with the present invention relates to this distance "d" shown in FIG. 9. The third improvement is as follows: the distance "d" must be two and one half (2½) to three (3) times a distance "x", where the distance "x" is defined to be the distance between the flange 12*a* and the snap latch body 18 that the flange 12*a* of snap latch 12 bends inwardly toward snap latch body 18 when the 15000 pound upward pulling force is applied to the tubing 20 at the wellbore surface for the purpose of disengaging the disengaging surface 14*b* of the external threads 14 on flange 12*a* from the internal threads 24 of the mandrel 23 of the packer assembly 22.

As a result of this specific distance "d", if any excess debris accumulates within the space defined by distance "d" between flange 12*a* and snap latch body 18 in FIG. 9, that debris will not prevent or inhibit the flange 12*a* from bending inwardly the required distance "x" in response to the 15000 pound pulling force on tubing 20 since the distance "d" is 2½ to 3 times the distance "x" and is therefore more than enough distance for each of the flanges 12*a* to bend and disengage from the internal threads 24.

In addition, since the geometry of the snap latch of the present invention is changed to minimize the auxiliary bending moment, the thickness or length "1" of the base 12*a*1 of the flange 12*a* in FIG. 9 is thicker than the thickness of the flange at the tip end 28*a* of the flange 12*a*.

A fourth improvement to the snap latch seal locator 10 of the present invention relates to the thickness or length "1" of the base 12*a*1 of each flange 12*a* of the snap latch 12. Recalling that the disengaging angle $\theta_d$. is the angle between the engaging surface 14*b* of each external thread 14 and a vertical, the higher the disengaging angle $\theta_d$. is, in degrees, the longer the length "1", or thickness, of the base 12*a*l must be in order to maintain constant the 15000 pound pull out force, the 15000 pound pull out force being required to unsnap the snap latch 12 from the packer assembly 22 when the operator at the wellbore surface attempts to pull the tubing string 20 out of the wellbore. The reason for this constraint is simple: the higher the disengaging angle, the easier is would be to disengage the snap latch 12 from the packer assembly 22. As a result, if the thickness or length "1" of the base 12*a*1 were not adjusted when the disengaging angle is increased, the pull out force would be quite a bit less than the desired 15000 pounds. Therefore, if the disengaging angle $\theta_d$. increases, the base 12*a*1 of each flange 12*a* must increase in length "1" or thickness in order to maintain constant the 15000 pound pull out force which is required to unsnap the snap latch 12 from the packer assembly 22 and pull the tubing string 20 out of the wellbore.

Figure 11:
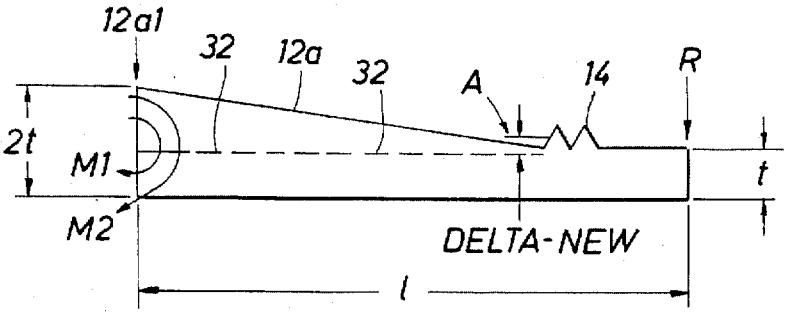
FIG. 11 illustrates a flange associated with the latch portion of the snap latch seal locator of the present invention of FIG. 1, the undesired auxilliary moment of FIG. 10 being approximately equal to zero because a new lever arm "delta-new" is approximately equal to zero.

Referring to FIGS. 10 and 11, a flange associated with a snap latch of the prior art is illustrated in FIG. 10, there being an undesired auxiliary bending moment created by an axially applied force "A" and a lever arm "delta-old", and a flange associated with the snap latch of the snap latch sea/locator of the present invention is illustrated in FIG. 11, the undesired auxiliary bending moment of FIG. 10 being approximately equal to zero because a new lever arm "delta-new" is approximately equal to zero.

A fifth improvement to the snap latch seal locator 10 of the present invention relates to the elimination of the undesired auxiliary bending moment "M2" by decreasing the length of the lever arm "delta-old" to an amount which is approximately equal to zero.

In FIG. 10, when the operator at the wellbore surface applies the required 15000 pound pulling force upwardly to the tubing string 20, two forces are applied to each flange 12*a* of the snap latch 12 of the snap latch seal locator 10: (1) a first force "R", which is the radial component of a second force "A" below, applied transversely at each external thread 14 of each flange 12*a*, where each distance between an external thread on the flange 12*a* where the first force "R" is applied and the base of the flange is designated by the length "1"; and (2) a second force "A" applied longitudinally along each flange 12*a* to each of the external threads 14 on the flange 12*a*. In response to the first and second force, a first moment "M1" and a second moment "M2" is created for each force, and each moment "M" is equal to the force times a lever arm.

The first moment "M1 ", associated with the first force "R", represents a torque applied to the base of each flange and is equal to the first force"R" times a first lever arm, the first lever arm being the length "1", which is a length between the application of force "R" at each of the external threads 14 and the base of the flange 12*a*. This first moment "M1" is desired and is not a problem.

However, the second moment "M2" assocated with the second force "A" is equal to the second force "A" times the a second lever arm "delta" or "δ". This second moment "M2" is a problem since it represents an undesired auxiliary bending moment or torque "M2" at the base of the flange which is created by a longitudinally directed second force "A" at each of the external threads 14. This undesired auxiliary bending moment "M2" must be eliminated.

In FIG. 10, a view of a flange of the prior art snap latch of FIG. 5 is illustrated. In this figure, each of the flanges of the prior art snap latch of FIG. 5 is approximately rectangular in cross section and it has a width of "t". The desired bending moment M1 is equal to the transversely applied first force "R" times the first lever arm "1", which is the length between the point of application of the first force "R" at each of the external threads 14 and the base of the flange 12*a*. However, the undesired auxiliary bending moment "M2" is created by the longitudinally applied second force "A" times a second lever arm "delta-old". The second lever arm "delta-old" is the transverse distance between the center of gravity 30 of the flange 12*a* and the direction of the second force A. Since the second lever arm "delta-old" is not zero, the undesired auxiliary bending moment "M2" is not zero. In order to eliminate the undesired auxiliary bending moment M2, each of the flanges of the prior art snap latch of FIGS. 5 and 10 must be redesigned in a way which will force the lever arm "delta-old" to be approximately equal to zero.

In FIG. 11, a view of one of the flanges 12*a* of the snap latch 12 of FIG. 6 of the snap latch seal locator 10 of FIG. 1 in accordance with the present invention is illustrated. In this figure, each of the flanges 12*a* of the snap latch 12 of FIG. 6 of the present invention is designed to make the base 12*a*1 thicker than the base of the prior art flange shown in FIG. 10. For purposes of illustration of this concept, assume that the base of the prior art flange shown in FIG. 10 has a width "t"; however, further assume that the base 12*a*1 of the flange 12*a* of the snap latch 12 of the present invention shown in FIG. 11 has a width "2t", which is twice the thickness of the base "t" in figure. 10. However, the tip (not the base) of the flange of FIG. 10 has a width "t" and the tip of the flange of FIG. 11 also has a width "t". As a result, in FIG. 11, since the width of the base is "2t", but the width of the tip is "t", the center of gravity 32 of the flange 12*a* of the present invention has shifted upwardly in FIG. 11, relative to the location of the center of gravity 30 shown in the prior art flange of FIG. 10. This shift of the center of gravity 32 upwardly in FIG. 11 has decreased the length of the second lever arm "delta-new". Recall that the second lever arm associated with the prior art flange in FIG. 10 is "delta-old". However, the second lever arm associated with the flange of the present invention in FIG. 11 is now "delta-new". Due to the shift of the center of gravity 32 upwardly in FIG. 11, "delta-new" is very much less than "delta-old". In fact, the second lever arm "delta-new" in FIG. 11 is approximately equal to zero. Therefore, since the second lever arm "delta-new" is approximately equal to zero, the undesired auxiliary bending moment "M2" in FIG. 11 is also approximately equal to zero.

Figure 12:
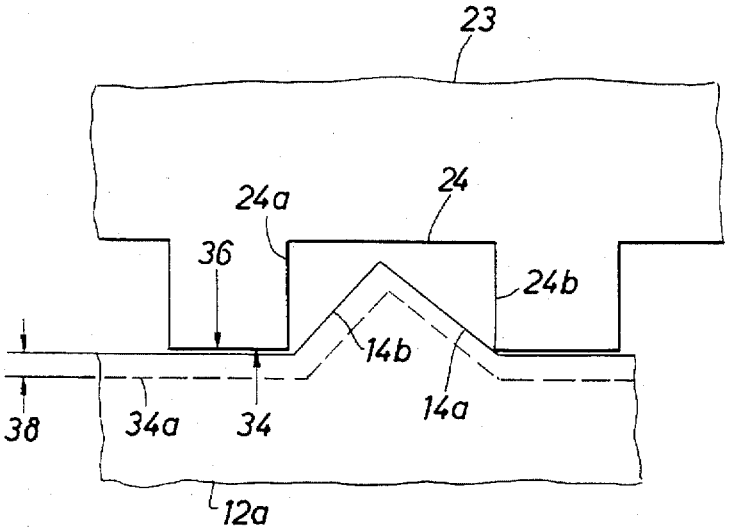
FIG. 12 illustrates an external thread on a flange of a latch portion of the snap latch of FIG. 1 in contact with an internal thread on an internal periphery of a mandrel of the packer, this figure illustrating the following basic principle in accordance with one aspect of the present invention: the OD of the latch flange>ID of the mandrel on the packer+tolerance stackup.

Referring to FIG. 12, this figure illustrates an external thread on a flange 12*a* of the snap latch 12 of FIG. 6 in contact with an internal thread 24 on an internal periphery of a mandrel 23 of the packer assembly 22.

A sixth improvement to the snap latch seal locator 10 of FIG. 1 of the present invention is represented by the following basic principle in accordance with one aspect of the present invention: the outer diameter (OD) of the flange 12*a* of the snap latch 12 is greater than the inner diameter (ID) of the mandrel 23 on the packer assembly plus a tolerance stackup.

In FIG. 12, a flange 12*a* of the snap latch 12 of FIG. 6 has an outer diameter (OD) 34 and the mandrel 23 of the packer assembly 22 has an inner diameter (ID) 36. An external thread 14*a* and 14*b* on the flange 12*a* connects to the OD 34 of the flange 12*a*, and an internal thread 24*a* and 24*b* on the mandrel 23 connects 16 the ID 36 of the mandrel 23. The external thread 14*a*, 14*b* on flange 12*a* mates with the internal thread 24*a* and 24*b* on mandrel 23.

In FIG. 12, this figure illustrates the OD 34 of flange 12*a* in direct contact with the ID 36 of mandrel 23, that is, OD 34=ID 36. However, in reality, this in not the case. In reality, the OD 34 is not equal to the ID 36. Due to the machining of the OD 34 of the flange 12*a*, there exists a "tolerance stackup" 38 on the surface of the flange 12*a*. As a result of this tolerance stackup 38, the OD 34 is not equal to the ID 36; rather, an OD 34*a* is less than (or greater than) the ID 36 by an amount equal to the tolerance stackup 38. Therefore, in reality, the external thread 14*a*, 14*b* on flange 12*a* does not mate directly with the internal thread 24*a*, 24*b* on mandrel 23. This increases the range of loads required for engaging the tubing string to the packer assembly and for disengaging the tubing string from the packer assembly. This is a problem which must be solved.

Therefore, in accordance with the sixth improvement to the snap latch seal locator 10 of the present invention, in order to take into account the existance of this "tolerance stackup", the following basic principle must be followed when manufacturing the flanges 12*a* of the snap latch 12 of the snap latch seal locator 10 and the mandrel 23 of the packer assembly 22:

OD 34>ID 36+tolerance stackup 38

The above basic principle indicates that the outer diameter 34 of the flange 12*a* in FIG. 12 should be greater thin the inner diameter 36 of the mandrel 23 plus the aforementioned tolerance stackup 38. If this basic principle is adhered to when manufacturing the flanges 12*a* of the snap latch 12 and the mandrel 23 of the packer assembly 22, the external thread 14*a*, 14*b* on flange 12*a* will mate directly with the internal thread 24*a*, 24*b* on the mandrel 23 as required.

Figure 13:
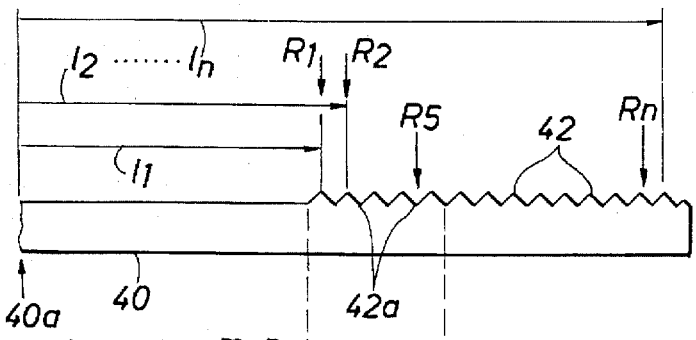
FIG.13 (PRIOR ART)
FIG. 13 illustrates the external threads on a flange of a prior art latch portion of a prior art snap latch seal locator.
Figure 14:
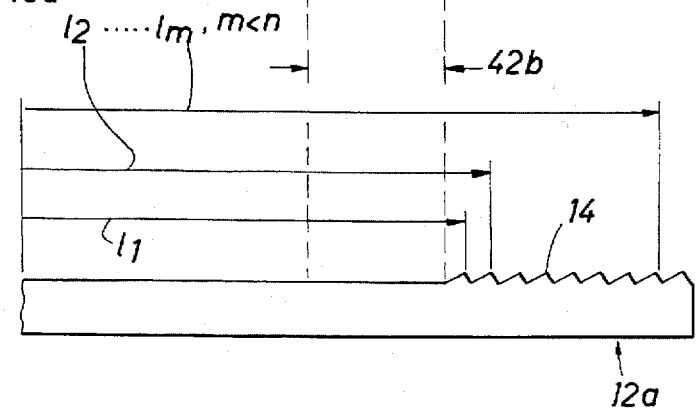
FIG. 14 illustrates the external threads on a flange of the latch portion of the snap latch of the present invention.

Referring to FIGS. 13 and 14, the external threads on a flange of a prior art snap is illustrated in FIG. 13 and the external threads 14 on a flange 12*a* of the snap latch 12 of FIG. 6 of the snap latch seal locator 10 of FIG. 1 of the present invention is illustrated in FIG. 14.

In FIG. 13, a prior art flange 40 of the prior art snap latch of FIG. 5 includes a multitude of external threads 42. Each of the external threads 42 are disposed a distance "1" from the base of the flange 40; for example, a first one of the external threads 42 lies a distance "11" from the base 40*a* of the flange 40, a second one of the external threads 42 lies a distance "12" from the base 40*a*, . . . , and an nth one of the external threads 42 42 lies a distance "1n" from the base 40*a*. Since each of the external threads 42 lies a different distance from the base 40*a*, each external thread 42 is associated with a different moment "M" at the base 40*a* since each external thread 42 has a force "R" applied transversely thereto and each external thread 42 has a different lever arm "1". For example, the first one of the external threads has a force "R1" applied transversely thereto and lies at a lever arm distance of "11" thereby developing a moment "M1" at the base 40*a*, and the second one of the external threads has a force "R2" applied transversely thereto and lies at a lever arm distance of "12" thereby developing a moment "M2" at the base 40*a*, etc. If there are "n" external threads 42, there are "n" moments (M1, M2, . . . , Mn) developed it the base 40*a* of the flange 40.

The problem with the snap latch of the prior art shown in FIGS. 5 and 13 is as follows: there are too many moments Mn developed at the base 40*a* of the flange 40; and, as a result, too many disengaging loads are required to disengage the snap latch of the prior art shown in FIG. 5 from the packer assembly 22 of FIG. 2. Since there are too many moments Mn developed at the base 40*a* of the flange 40, it is too hard to predict what load will engage the tubing to the packer assembly and/or disengage the tubing from the packer assembly.

A seventh improvement to the snap latch seal locator 10 of FIG. 1 relates to the elimination of some of the external threads 42 from the prior art flange of FIG. 13 thereby decreasing the number of moments developed at the base 40*a* of the flange 40 and thereby further decreasing the number of disengaging loads which are required to disengage the snap latch 12 of the .snap latch seal locator 10 of FIG. 1 from the packer assembly 22 of FIG. 2.

Accordingly, referring to FIGS. 13 and 14, the external threads 42*a* on the prior art flange of the prior art snap latch of FIG. 13, which lie within the interval 42*b*, have been eliminated. As a result, the external threads 14 of the snap latch 12 of the present invention of FIG. 14 are shorter in length than the external threads 42 of the prior art snap latch of FIG. 13 by an amount equal to the external threads 42*a* which lie within the interval 42*b*.

As a result, the number of disengaging loads, required to disengage the snap latch 12 of the present invention of FIG. 6 from the packer assembly 22, has been minimized; and, since the number of disengaging loads has been minimized; the pull out force, required to pull the tubing 20 out of the packer assembly 22 of FIGS. 1 and 2, can be maintained closer to 15000 pounds.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A latch for positioning in a debris filled wellbore for interconnecting a first wellbore apparatus to a second wellbore apparatus in the wellbore, comprising:

an annular base;

a plurality of spaced axially extending resilient flanges connected to the base, the plurality of spaced resilient flanges defining a plurality of axially extending gaps disposed, respectively, between the plurality of spaced resilient flanges; and an elastomeric barrier having a top part and a plurality of extension members connected to the top part, the plurality of extension members being disposed, respectively, within the plurality of gaps between the plurality of spaced flanges to close said gaps thereby preventing the debris in said wellbore from entering said latch from said gaps.

2. The latch of claim 1, wherein said latch is connected to said first wellbore apparatus and is latched into said second wellbore apparatus thereby interconnecting said first wellbore apparatus to said second wellbore apparatus in said wellbore, said latch enabling said first wellbore apparatus to be pulled out of and removed from said second wellbore apparatus in response to a predetermined amount of pulling force applied to said first wellbore apparatus, further comprising:

a plurality of external threads disposed around an external periphery of said plurality of flanges, each of said external threads having an engaging surface and a disengaging surface with debris in said wellbore having a tendency to accumulate on said disengaging surface, an angle between said disengaging surface and a vertical lying in a range between approximately twenty (20 ) degrees and approximately twenty eight (28) degrees, said angle within said range between said disengaging surface and said vertical minimizing collection of debris on said disengaging surface so that a predetermined amount of said pulling force is effective to pull said first wellbore apparatus out of said second wellbore apparatus.

3. The latch of claim 2, further comprising:

A snap latch body disposed adjacent to said plurality of flanges, a space being defined by said flanges and said snap latch body having a radial thickness "d" with said space positioned for collecting debris which may bypass said barrier and enter said space, said axially extending resilient flanges being mounted for bending a particular distance "x" across said space, said radial thickness "d" being greater than said distance "x" and preventing said debris in said space from changing said predetermined amount of said pulling force required to pull said first wellbore apparatus out said second wellbore apparatus.

4. The latch of claim 3, ,wherein said distance "t" lies in a range between 2½ times said particular distance "x" to 3 times said particular distance "x".

5. The latch of claim 1, wherein said latch is arranged for connecting to said first wellbore apparatus and for latching into said second wellbore apparatus thereby interconnecting said first wellbore apparatus to said second wellbore apparatus in said wellbore, said latch enabling said first wellbore apparatus to be pulled out of and removed from said second wellbore apparatus in response to a predetermined amount of pulling force applied to said first wellbore apparatus, further comprising:

a snap latch body disposed adjacent to said plurality of flanges, a space being defined between said flanges and said snap latch body having a radial thickness "d" with said space positioned for collecting debris, said axially extending resilient flanges being mounted for bending a particular distance "x" across said space, said radial thickness "d" being substantially greater than said distance "x" to prevent debris which may bypass said barrier and enter into said space from changing said predetermined amount of said pulling force required to pull said first wellbore apparatus out of said second wellbore apparatus.

6. The latch of claim 5, wherein said distance "t" lies in a range between 2½ times said particular distance "x" to 3 times said particular distance "x".

7. The latch of claim 1, further comprising:

a plurality of external threads disposed around an external periphery of said plurality of flanges, an axial force for application axially along a surface of said flanges to said plurality of external threads thereby applying an undesired auxiliary bending moment to a base of said flanges, said flanges each having a center of gravity, a transverse distance between said center of gravity and said axial force being approximately equal to zero, said undesired auxiliary bending moment being approximately equal to zero as said transverse distance between said center of gravity and said axial force is approximately equal to zero.

8. The latch of claim 7, wherein said latch is arranged for connecting to said first wellbore apparatus and for latching into said second wellbore apparatus thereby interconnecting said first wellbore apparatus to said second wellbore apparatus in said wellbore, said latch enabling said first wellbore apparatus to be pulled out of and removed from said second wellbore apparatus in response to a predetermined amount of pulling force applied to said first wellbore apparatus and wherein each of said external threads have an engaging surface and a disengaging surface with debris in said wellbore having a tendency to accumulate on said disengaging surface, an angle between said disengaging surface and a vertical lying in a range between approximately twenty (20) degrees and approximately twenty eight (28) degrees, said angle within said range between said disengaging surface and said vertical minimizing collection of debris on said disengaging surface so that a predetermined amount of said pulling force is effective to pull said first wellbore apparatus out of said second wellbore apparatus.

9. The latch of claim 8, further comprising:

a snap latch body disposed adjacent to said plurality of flanges, a space being defined by said flanges and said snap latch body, having a radial thickness "d" with said space positioned for collecting debris, said axially extending resilient flanges being mounted for bending a particular distance "x" across said space, said radial thickness "d" being substantially greater than said distance "x" to minimize debris which may bypass said barrier and enter said space from changing said predetermined amount of said pulling force required to pull said first wellbore apparatus out of said second wellbore apparatus.

10. The latch of claim 9, wherein said distance "d" lies in a range between 2½ times said particular distance "x" to 3 times said particular distance "x".

11. A latch adapted to be disposed in a debris filled wellbore for interconnecting a first wellbore apparatus to a second wellbore apparatus in said wellbore, said latch enabling said first wellbore apparatus to be removed from said second wellbore apparatus in response to a predetermined amount of force applied to said first wellbore apparatus, comprising:

a base;

a plurality of flanges connected to the base, the plurality of flanges defining a plurality of gaps disposed, respectively, between the plurality of flanges; and a plurality of external threads disposed around an external periphery of said plurality of flanges, each of said external threads having an engaging surface and a disengaging surface with debris having a tendency to accumulate on said disengaging surface, an angle between said disengaging surface and a vertical lying in a range between approximately twenty (20 ) degrees and approximately twenty eight (28) degrees, said angle within said range minimizing collection of debris on said disengaging surface so that a predetermined amount of force is effective to remove said first wellbore apparatus from said second wellbore apparatus.

12. The latch of claim 11, further comprising:

an elastomeric barrier having a top part and a plurality of extension members connected to the top part, the plurality of extension members being disposed, respectively, within the plurality of gaps between the plurality of flanges, said barrier including said extension members preventing said debris in said wellbore from entering said latch through said plurality of flanges.

13. A latch for positioning in a debris filed wellbore for interconnecting a first wellbore apparatus to a second wellbore apparatus in said wellbore, said latch enabling said first wellbore apparatus to be removed from said second wellbore apparatus in response to a predetermined amount of force applied to said first wellbore apparatus, comprising:

a base;

a plurality of flanges connected to the base, the plurality of flanges defining a plurality of gaps disposed, respectively, between the plurality of flanges; and a snap latch body disposed adjacent to said plurality of flanges, a space being defined by said flanges and said snap latch body having a radial thickness "d" with said space positioned for collecting debris, said axially extending resilient flanges being mounted for bending a particular distance "x" across said space, said radial thickness "d" being substantially greater than said distance "x" to prevent debris which may enter and locate in said space, from changing said predetermined amount of force required to remove said-first wellbore apparatus from said second wellbore apparatus.

14. The latch of claim 13, wherein said distance "d" lies in a range between 2½ times said particular distance "x" to 3 times said particular distance "x".

15. The latch of claim 14, further comprising:

an elastomeric barrier having a top part and a plurality of extension members connected to the top part, the plurality of extension members being disposed, respectively, within the plurality of gaps between the plurality of flanges, said extension members preventing said debris from entering said latch through said plurality of flanges.

16. A latch for positioning in a debris filled wellbore for interconnecting a first wellbore apparatus to a second wellbore in said wellbore, comprising:

a base;

a plurality of flanges connected to the base, the plurality of flanges defining a plurality of gaps disposed, respectively, between the plurality of flanges; and a plurality of external threads disposed around an external periphery of said plurality of flanges, an axial force for application axially along a surface of said flanges to said plurality of external threads, said axial force applying an undesired auxiliary bending moment to a base of said flanges when said axial force is applied to said external threads, said flanges each having a center of gravity, a transverse distance between said center of gravity and said axial force being approximately equal to zero, said undesired auxiliary bending moment being approximately equal to zero as said transverse distance between said center of gravity and said axial force is approximately equal to zero.

17. The latch of claim 16, further comprising:

an elastomeric barrier having a top part and a plurality of extension members connected to the top part, the plurality of extension members being disposed, respectively, within the plurality of gaps between the plurality of flanges, said extension members preventing said debris from entering said latch through said plurality of flanges.

18. A snap latch for interconnecting a tubing string to a wellbore apparatus in a wellbore, the wellbore apparatus including a mandrel having internal threads, comprising:

a plurality of spaced axially extending resilient flanges having external threads for mating with the internal threads of said mandrel of said wellbore when said tubing string is interconnected to said wellbore apparatus in said wellbore, said flanges of said snap latch each have an outer diameter, said mandrel of said wellbore apparatus having an inner diameter, said outer diameter of each of said flanges being greater than said inner diameter of said mandrel of said wellbore apparatus plus a tolerance stackup before said snap latch interconnects said tubing string to said wellbore apparatus in said wellbore, said tolerance stackup representing an error differential resulting from a machining of said flanges of said snap latch;

said resilient flanges bending radially inwardly for release of said latch and tubing string from said mandrel upon an upward pulling force on said tubing string.

* * * * *